US009903151B2

(12) United States Patent
Bourbon

(10) Patent No.: US 9,903,151 B2
(45) Date of Patent: Feb. 27, 2018

(54) PLATFORM LANDING DOOR CASEMENT COMPRISING A GLASS PANE AND ASSOCIATED METHODS FOR FITTING AND REMOVING THE GLASS PANE FROM THE PLATFORM

(71) Applicant: Faiveley Transport Tours, Saint-Pierre-des-Corps (FR)

(72) Inventor: Bruno Bourbon, Esvres-sur-Indre (FR)

(73) Assignee: FAIVELEY TRANSPORT TOURS, Saint-Pierre-des-Corps (FR)

( * ) Notice: Subject to any disclaimer, the term of this patent is extended or adjusted under 35 U.S.C. 154(b) by 0 days.

(21) Appl. No.: 15/196,259

(22) Filed: Jun. 29, 2016

(65) Prior Publication Data

US 2017/0002600 A1 Jan. 5, 2017

(30) Foreign Application Priority Data

Jul. 3, 2015 (EP) ..... 15306096

(51) Int. Cl.
*B61B 1/02* (2006.01)
*E06B 3/54* (2006.01)
(Continued)

(52) U.S. Cl.
CPC ..... *E06B 3/5454* (2013.01); *B61B 1/02* (2013.01); *E06B 1/524* (2013.01); *E06B 3/26* (2013.01); *E06B 3/28* (2013.01); *E06B 3/4609* (2013.01); *E06B 3/54* (2013.01); *E06B 3/5481* (2013.01); *E06B 3/58* (2013.01); *E06B 3/4636* (2013.01)

(58) Field of Classification Search
CPC ..... E06B 3/5454; E06B 3/54; E06B 3/4609; E06B 1/524; E06B 3/26; E06B 3/28;
(Continued)

(56) References Cited

U.S. PATENT DOCUMENTS 2,727,597 A * 12/1955 Musgrave ..... E06B 3/58 52/775
4,635,400 A * 1/1987 Mullet ..... E06B 1/045 49/504
(Continued)

FOREIGN PATENT DOCUMENTS

CN 101059057 10/2007
CN 102085868 6/2008
(Continued)

OTHER PUBLICATIONS

Search Report dated Jan. 5, 2016 out of European Priority Application No. 15306096.7 (3 pages).

*Primary Examiner* — Brent W Herring
(74) *Attorney, Agent, or Firm* — Brinks Gilson & Lione; G. Peter Nichols

(57) ABSTRACT

A platform landing door casement includes a platform face; a casement frame with first and second lateral uprights separated from one another by cross members to delimit a glazing opening; a glass pane mounted in the glazing opening by being received in the lateral uprights and the cross members; a glazing bead mounted removably on one of the lateral uprights by reversible fixing means; and a glazing bead cover mounted removably on the glazing bead. The glazing bead and the glazing bead cover being mounted on the platform face side and the casement further including, on the platform face side, a protective trim for locking and securing the glazing bead cover on the glazing bead.

15 Claims, 5 Drawing Sheets

(51) Int. Cl.

| | |
|---|---|
| ***E06B 3/58*** | (2006.01) |
| ***E06B 1/52*** | (2006.01) |
| ***E06B 3/26*** | (2006.01) |
| ***E06B 3/28*** | (2006.01) |
| *E06B 3/46* | (2006.01) |

(58) Field of Classification Search

CPC ..... E06B 3/5481; E06B 3/58; E06B 3/4636; B61B 1/02

USPC ... 52/204.1, 204.5, 204.53, 204.597, 204.62, 52/204.67, 204.68, 207, 211, 214; 49/130, 463, 465, 466

See application file for complete search history.

(56) References Cited

U.S. PATENT DOCUMENTS 5,381,618 A * 1/1995 Singleton ..... G09F 7/18 248/551
6,151,849 A * 11/2000 Twigg ..... E06B 3/5892 52/204.53
6,715,245 B2 * 4/2004 Lewkowitz ..... E06B 7/30 52/204.53
7,340,866 B1 * 3/2008 Smith ..... E06B 1/003 52/204.54
8,359,796 B1 * 1/2013 Plummer ..... E06B 3/5892 52/204.61
8,365,480 B1 * 2/2013 Plummer ..... E06B 3/5892 52/204.62
9,027,293 B1 * 5/2015 Scott ..... E06B 9/02 428/99
2003/0000163 A1 * 1/2003 Lamanna ..... E06B 3/5892 52/204.62
2008/0190031 A1 8/2008 Winkelmann
2015/0107169 A1 * 4/2015 Scott ..... E06B 9/02 52/202

FOREIGN PATENT DOCUMENTS

| | | |
|---|---|---|
| KR | 2012 013 2376 | 12/2012 |
| WO | WO 2006/131018 | 12/2006 |
| WO | WO 2008/149246 | 12/2008 |
| WO | WO 2010/016018 | 2/2010 |

* cited by examiner

PLATFORM LANDING DOOR CASEMENT COMPRISING A GLASS PANE AND ASSOCIATED METHODS FOR FITTING AND REMOVING THE GLASS PANE FROM THE PLATFORM

This application claims priority to European Patent Application No. 15306096.7 filed on Jul. 3, 2015, the entire contents of which is incorporated herein by reference.

BACKGROUND

The invention relates to a landing door casement for a platform running along a traffic lane and including a glass pane. The invention relates also to a method for removing the glass pane and a method for fitting the glass pane, the two methods being implemented from the platform.

SUMMARY

The platform landing doors make it possible to separate the platform deck from the traffic lane. These landing doors comprise doors that slide in their plane which make it possible to free or block a passage for access to a passenger vehicle parking along the platform on the traffic lane. Generally, each access passage includes a pair of sliding doors whose respective translational movements are symmetrical mirror-wise. Also, each sliding door moves relative to a fixed part of the landing door. This fixed part is equipped with emergency doors. Whether sliding doors or emergency doors, the casements thereof generally include at least one glazing panel. Hereinafter in the description, the platform landing door casement can refer both to the casement of the sliding door and to the casement of the emergency door.

In order to perform maintenance on the glazing panel of a platform landing door casement, such as the replacement of a degraded glass pane, it is usually performed from the traffic lane so that the dismantle able elements allowing access to the glass pane are not within reach of the users from the platform. That requires this maintenance to occur outside of the traffic lane service hours.

Now, vandalism, in particular, on certain traffic lanes, such as a subway line, may require a daily replacement of degraded glass panes. It is then no longer possible to perform the replacement of all the degraded glass panes over just the between-service period of the traffic lane.

There is therefore a need to have a platform landing door casement which allows replacement of a glass pane at any time of the day during the traffic lane service hours.

To that end, there is provided, according to the invention, a platform landing door casement comprising:

a platform face;

a casement frame comprising first and second lateral uprights separated from one another by first and second cross members, the first and second lateral uprights and the first and second cross members delimiting a glazing opening;

a glass pane mounted in the glazing opening by being received in the first and second lateral uprights and the first and second cross members;

a glazing bead mounted removably on one of the first and second lateral uprights by reversible fixing means, for retaining the glass pane in the glazing opening; and, a glazing bead cover mounted removably on the glazing bead to conceal the reversible fixing means;

the glass pane, the glazing bead and the glazing bead cover being mounted on the platform face side and the casement further comprising, on the platform face side, a protective trim for locking and securing the glazing bead cover on the glazing bead.

Thus, the fact that the dismantleable elements such as the glass pane, the glazing bead and the glazing bead covers are accessible from the platform, because they are mounted on the platform face of the casement, allows for a maintenance intervention which does not monopolize the traffic lane. Furthermore, with such a casement, it is possible to perform the maintenance without having to open the casement: this makes it possible to not interrupt service on the traffic lane since all the platform landing doors remain operational. Also, using a locking and securing protective trim makes the removal of the dismantleable elements impossible by a user of the platform.

Advantageously, but optionally, the casement according to the invention presents at least one of the following additional technical features:

the other of the first and second lateral uprights comprises a profile member comprising a groove for receiving and holding a lateral edge of the glass pane;

the profile member is of a single piece;

the casement further comprises first and second cross member covers mounted, on the platform face side, removably on the first and second cross members respectively, the first and second cross member covers comprising a first lateral end received in the other of the first and second lateral uprights and a second lateral end, opposite the first lateral end, retained by the glazing bead;

the first and second cross member covers are clipped onto the first and second cross members respectively;

the glazing bead cover is clipped onto the glazing bead;

the reversible fixing means comprise fixing screws; and, the glass pane comprises an ant-graffiti film.

Also provided, according to the invention, is a method for removing a glass pane from a casement having at least one of the preceding technical features comprising, from the platform face, steps of:

unlocking and removing the protective trim; then, removing the glazing bead cover; then, removing the reversible fixing means and removing the glazing bead; then, removing the glass pane from the glazing opening.

Advantageously, but optionally, the removal method according to the invention presents at least one of the following additional technical features:

prior to the removal of the glass pane and following the removal of the glazing bead, the method comprises a step of removal of the first and second cross member covers; and the removal of the glass pane is performed by a tilting of the glass pane on an axis parallel to a longitudinal axis of the other of the first and second lateral uprights.

Also provided, according to the invention, is a method for fitting a glass pane of a casement presenting at least one of the preceding technical features, comprising, from the platform face, steps of:

placement of the glass pane in the glazing opening; then, placement of the glazing bead then of the reversible fixing means in one of the first and second lateral uprights; then, placement of the glazing bead cover on the glazing bead; then, placement and locking of the protective trim.

Advantageously, but optionally, the fitting method according to the invention presents at least one of the following additional technical features:

following the placement of the glass pane and prior to the placement of the glazing bead, the method comprises a step of placement of the first and second cross member covers on the first and second cross members respectively;

the step of placement of the glass pane comprises sub steps of:

pressing a bottom edge of the glass pane onto a bottom cross member out of the first and second cross members; then, insertion of a lateral edge of the glass pane into the other of the first and second lateral uprights; then, tilting of the glass pane in the opening on an axis parallel to a longitudinal axis of the other of the first and second lateral uprights; and, the fitting method comprises a preliminary step of cleaning and/or replacement of seals of the glazing opening.

BRIEF DESCRIPTION OF THE DRAWINGS

Other features and advantages of the invention will become apparent from the following description of an embodiment. In the attached drawings.

DETAILED DESCRIPTION

Figure 1:
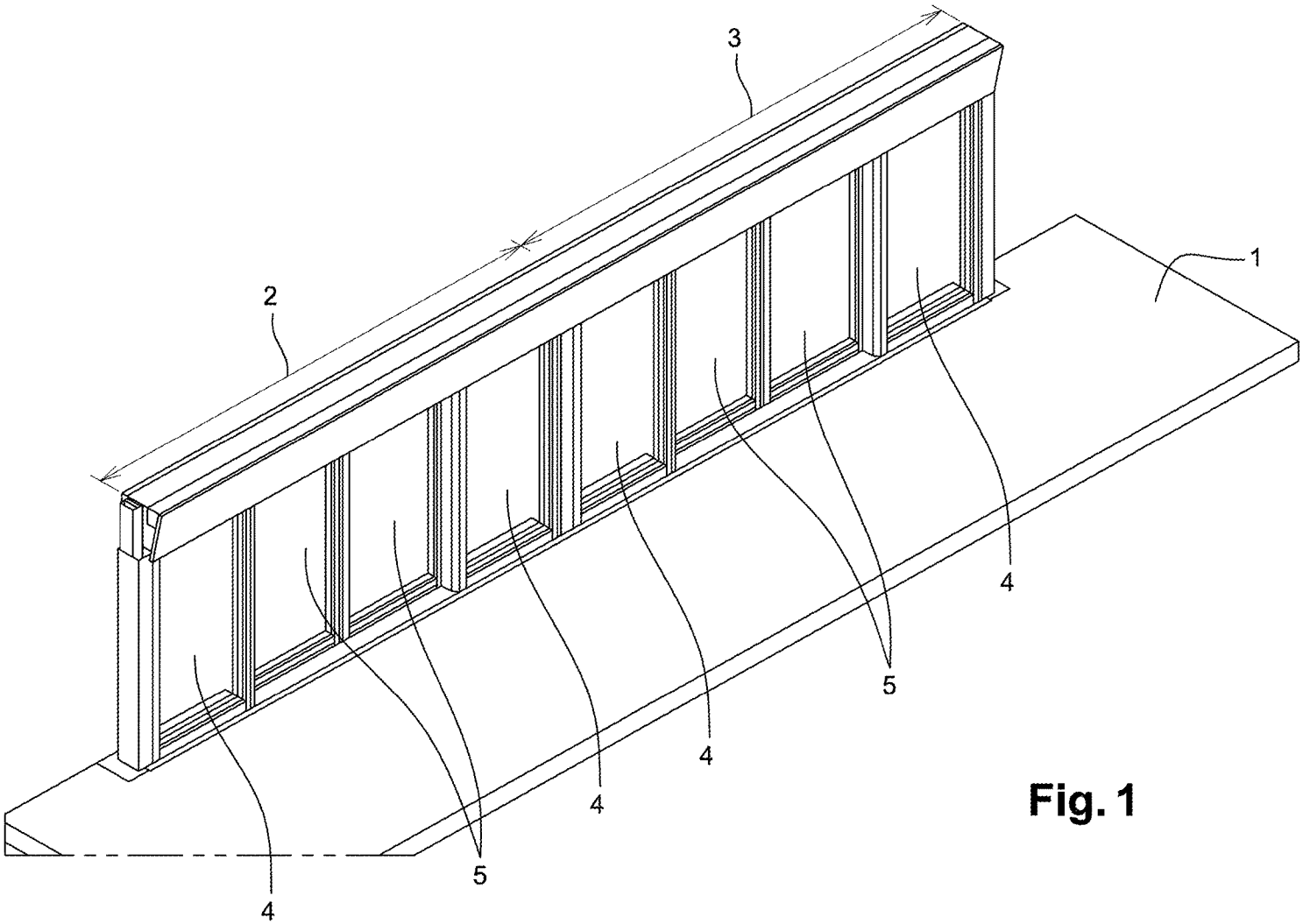
FIG. 1 is a three-dimensional view of a set of platform landing doors installed on a platform edge.
Figure 3:
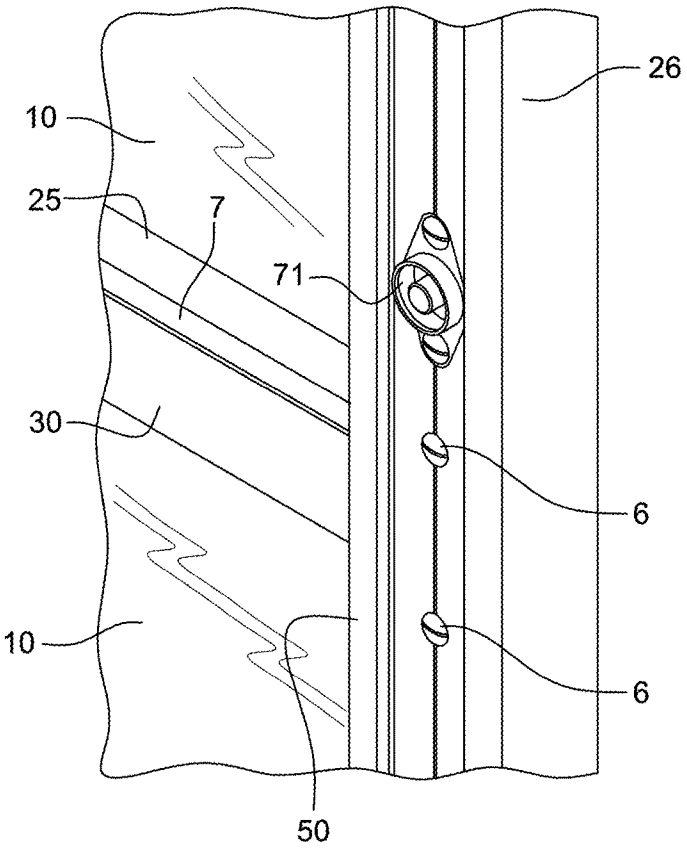
FIG. 3 is a detailed view at the level of the protective trim of the casement of FIG. 2, with the glazing bead cover removed.
Figure 2:
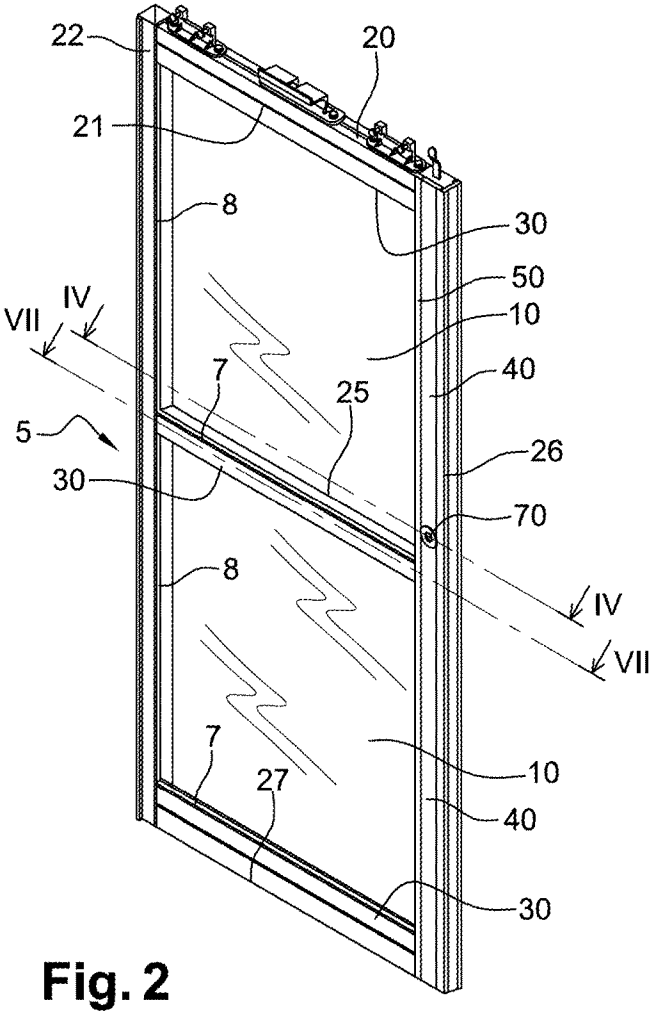
FIG. 2 is a three-dimensional view of a casement according to the invention of a landing door of FIG. 1.

Referring to FIG. 1, there now follows a brief description of a platform 1 equipped with landing doors. The platform 1 runs along a traffic lane (not represented). At a head end of the platform 1, a set of landing doors 2, 3 is positioned. Here, the landing doors form landing door modules. Each landing door module 2, 3 comprises an access passage which is blocked or freed by a pair of sliding doors, each comprising a sliding casement 5. On either side of the passage, the landing door module 2, 3 comprises two fixed parts each equipped with an emergency door comprising an emergency casement 4. The two fixed parts frame the access passage associated with the landing door module. Each of the sliding casements 5 moves in translation relative to the fixed part to which it is linked. Herein below, the landing door casement denotes both the sliding casement and the emergency casement.

Referring to FIGS. 2 to 7, there now follows a detailed description of a casement according to the invention. Here for purely illustrative purposes, the description of the casement according to the invention is provided with reference to a sliding casement 5. The rest of the description applies equally to an emergency casement 4.

The casement 5 according to the invention comprises a casement frame 20. The casement frame 20 comprises a first lateral upright 22 and a second lateral upright 26. The first 22 and second 26 lateral uprights are separated from one another by cross members 21. Here, there are three cross members 21, 25, 27: a top first cross member 21, an intermediate second cross member 25 situated substantially at mid-height of the casement 5 according to the invention and a bottom third cross member 27. The first 22 and second 26 lateral uprights and the first 21 and second 25 cross members delimit a glazing opening in which a glass pane 10 is mounted. Similarly, the first 22 and second 26 lateral uprights and the second 25 and third 27 cross members delimit another glazing opening in which another glass pane 10 is mounted.

In a variant embodiment, the casement frame comprises only a top first cross member 21 and a bottom second cross member and it has only a single glass pane 10 extending over the entire height of the casement according to the invention.

According to another variant embodiment, the casement frame comprises a top first cross member 21 and an intermediate second cross member 25 substantially at mid-height of the casement according to the invention, the part of the casement according to the invention below the intermediate second cross member being solid.

Also, the casement 5 according to the invention comprises a platform face, corresponding to the visible face in FIGS. 1, 2, 3 and 5, and a lane face not visible in the figures. On the platform face side of the casement 5 according to the invention, the latter comprises a glazing bead 50 mounted removably along one 26 of the first 22 and second 26 lateral uprights. Reversible fixing means 6 ensure the mounting of the glazing bead 50 onto the lateral upright 26. Here, the reversible fixing means 6 are screws comprising a screw head with a specific imprint which requires a specific screwdriver tip of complementary form, the screws cooperating with the nuts 61 fixed to one 26 of the first 22 and second 26 lateral uprights. The reversible fixing means 6 are distributed over the entire length of the glazing bead 50. Once mounted on one 26 of the first 22 and second 26 lateral uprights, the glazing bead 50 defines therewith a groove 24 for receiving an edge of the glass pane 10. The receiving groove 24 is then U-shaped in section, an interior face of each of the branches of the "U" receiving a seal 9, which is, for example, made of EPDM (ethylene propylene diene monomer). One 26 of the first 22 and second 26 lateral uprights comprises a protective trim base 71 which protrudes from the glazing bead 50. The protective trim base 71 is fixed here onto the upright by two reversible fixing means 6. The glazing bead 50 comprises an orifice 53 passing through a thickness of the glazing bead 50, the orifice 53 receiving the protective trim base 71. In section, the glazing bead 50 comprises, from left to right in FIG. 4, a first part forming one 51 of the branches of the "U" shape in section of the receiving groove 24, then a concave part comprising a flat bottom 52 in the thickness of which are formed the orifice 53 and orifices for receiving the reversible fixing means 6 and two lateral walls 54, each comprising a protuberance protruding toward the interior of the concave part.

Figure 5:
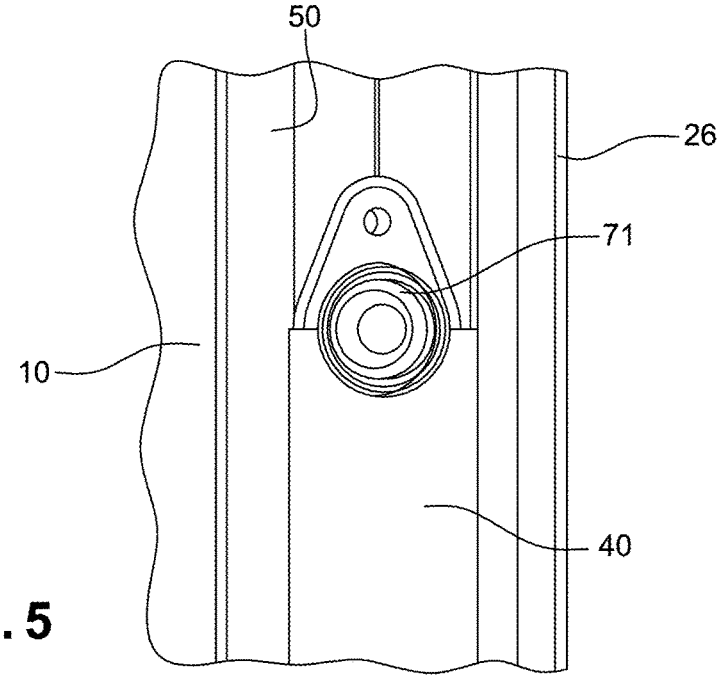
FIG. 5 is a detailed view at the level of the protective trim of the casement of FIG. 2, with a glazing bead cover fitted.
Figure 4:
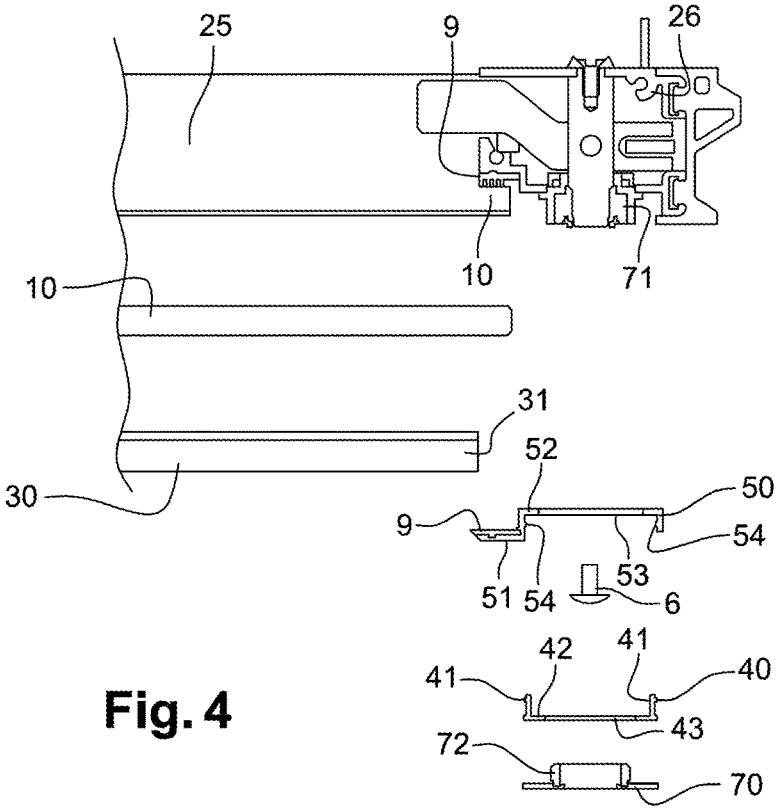
FIG. 4 is an exploded view in partial cross section along IV-IV.
Figure 6:
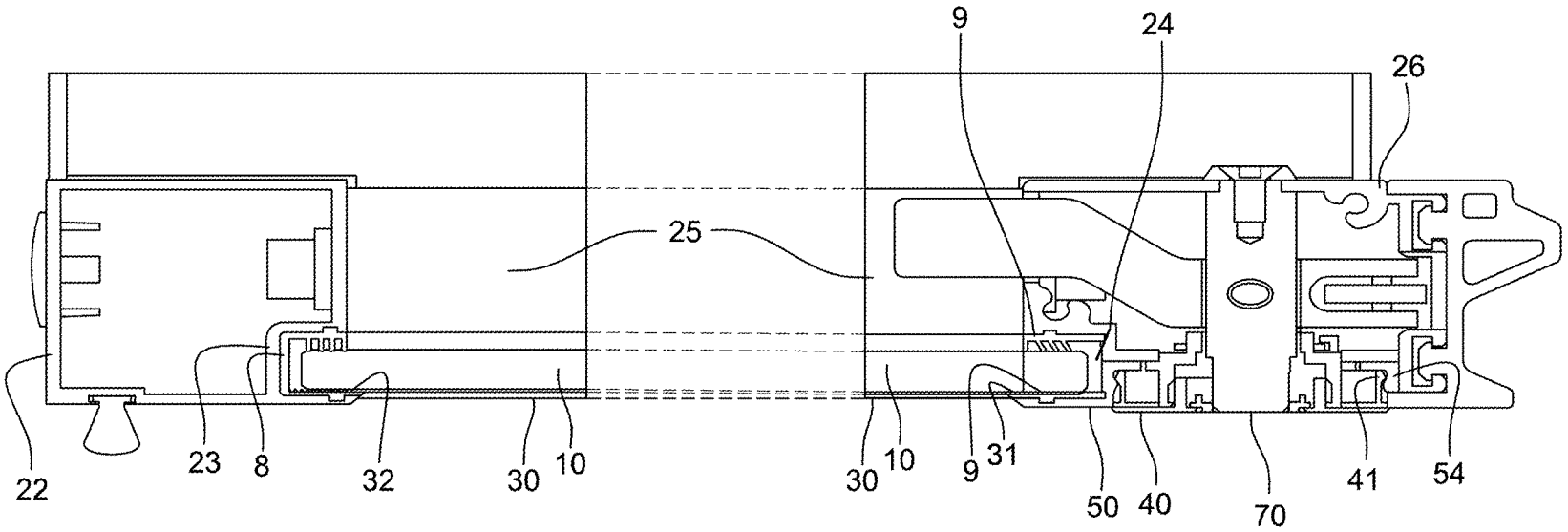
FIG. 6 is a view in cross section along IV-IV.
Figure 7:
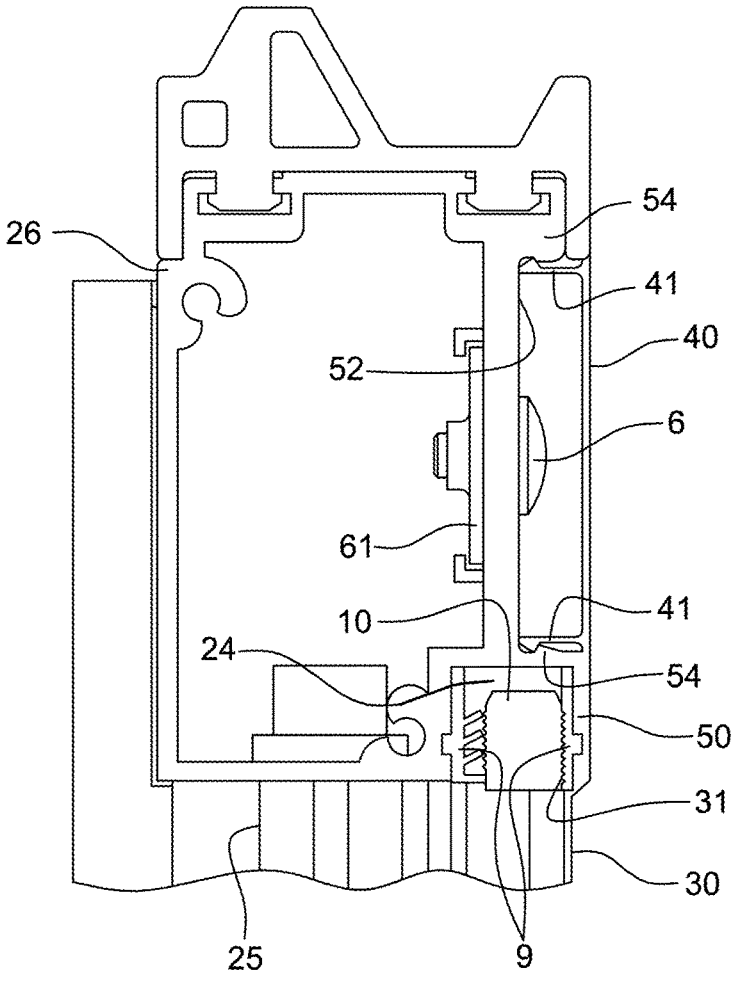
FIG. 7 is a view in partial cross section along VII-VII.

Furthermore, the casement 5 according to the invention comprises, still on the platform face side, a glazing bead cover 40 which encloses the concave part of the glazing bead 50 to conceal and block access to the reversible fixing means 6. The glazing bead cover 40 comprises a planar longitudinal strip 42 comprising, on each of its longitudinal edges, a branch 41 comprising a hook. When the glazing bead cover 40 is fitted onto the glazing bead 50, here by clipping, the hooks of the branches 41 of the glazing bead cover 40 cooperate with the protuberances of the lateral walls 54 of the concave part of the glazing bead 50. The glazing bead cover 40 further comprises an orifice 43 passing through the strip 42 which slidingly receives a tip of the protective trim base 71. The glazing bead cover is either of a single piece covering the entire length of the glazing bead 50, or in two pieces, as illustrated in FIG. 5, abutted with one another on fitting, the through orifice 43 straddling the two abutted pieces.

To lock and secure the glazing bead cover 40 onto the casement 5 according to the invention, the casement 5 according to the invention comprises, still on the platform face side, a locking and securing protective trim 70 which is positioned to be locked and secured onto the protective trim base 71. The locking and securing protective trim 70 comprises locking means 72 cooperating with the protective trim base 71 and a head 70 that comes to bear against the glazing bead cover 40, upon fitting, by covering the through orifice 42 thereof. To apply the locking and securing protective trim, a specific tool is necessary. Thus, it is not possible to remove the locking and securing protective trim 71 manually or with conventional tools.

The other 22 of the first 22 and second 26 lateral uprights comprises a profile member 22 which here is of a single piece and which comprises a receiving groove 23, the inside of which is covered with a seal 8. The receiving groove 23 receives and retains a lateral edge of the glass pane 10.

The casement 5 according to the invention further comprises, still on the platform face side, cross member covers 30 mounted removably on the cross members 21, 25, 27. For example, the cross member covers 30 are clipped onto the cross members 21, 25, 27. Each cross member cover 30 comprises first 32 and second 31 lateral ends. When assembling, still on the platform face side, the first lateral end 32 is inserted into the receiving groove 23 of the other 22 of the first 22 and second 26 lateral uprights. The second lateral end 31 is retained in the receiving groove 24 of one 26 of the first 22 and second 26 lateral uprights by the glazing bead 50, when this glazing bead 50 is fitted. Also, each cross member cover 30 serves as glazing bead for the bottom and/or top edges of the glass panes 10. It comprises, optionally, along its longitudinal edge/edges, a seal in contact with the glass pane(s) that it retains.

It should be noted that all the seals 8, 9 are mounted to be able to be replaced if necessary during maintenance. Preferably, they are produced in EPDM. In addition, the seals also make it possible to grip the glass pane and avoid the vibrations between the glass pane and the casement structure.

With the sliding casements 5 produced according to the invention, the other 22 of the first 22 and second 26 lateral uprights corresponds to the lateral upright which is on the side of the fixed part associated with the sliding casement 5 concerned. In the case of the emergency casements 4, the other 22 of the first 22 and second 26 lateral uprights corresponds to the lateral upright which bears the hinges or the pivots, or even any system allowing a rotational movement of the emergency casement about a vertical axis.

There now follows a description of a method according to the invention for removing a glass pane from a casement according to the invention just described. All of the operations which will be described are performed on the platform face side, with the casement 4, 5 in a closed position. It should be noted that, for the sliding casement 5, in closed position (illustrated in FIG. 1), the other 22 of the first 22 and second 26 lateral uprights is partially concealed, on the platform side, by the associated fixed part. That is why this lateral upright does not have any removable element.

First, the operator removes the locking and securing protective trim 70 using a specific tool.

Second, the operator removes the glazing bead cover 40 by unclipping the latter from the glazing bead 50 by freeing the hooks of the branches 41 of the glazing bead cover 40 from the protuberances of the lateral walls 54 of the glazing bead 50.

Then, the operator removes the glazing bead 50. For that, he removes all the reversible fixing means 6, then made accessible by the removal of the glazing bead cover 40, using suitable tools.

Next, the operator removes the cross member covers 30 which are below and above the glass pane 10 to be removed. The glass pane 10 is then held in the glazing opening only by the lateral edge of the glass pane which is inserted and retained in the receiving groove 23 of the other 22 of the first 22 and second 26 lateral uprights.

Finally, the operator removes the glass pane 10 to be replaced. For that, he introduces, between the glass pane 10 to be replaced and the bottom of the receiving groove 24, a lever, like a flat blade screwdriver, to tilt the glass pane about an axis parallel to a longitudinal axis of the other 22 of the first 22 and second 26 lateral uprights. In a variant, the operator uses suckers positioned on the glass pane to manipulate it. This tilting is made possible by deformation (flattening) of the seal 8 with which the receiving groove 23 is equipped. The glass pane 10 is then bearing on the cross member 25 or 27 situated under the glass pane 10. A simple translational movement then makes it possible to completely remove the glass pane 10 to be replaced.

Once the degraded glass pane has been removed a new replacement glass pane is fitted onto the casement according to the invention. For that, there now follows a description of a method according to the invention for fitting a glass pane of a casement according to the invention. Once again, all the operations which will be described are performed on the platform face side, the casement 4, 5 being in a closed position.

In a preliminary step, the operator cleans the seals 8, 9 and optionally replaces them if necessary.

First, the operator fits the new glass pane 10. For that, the glass pane 10 is fitted bearing by its bottom edge on the cross member 25 or 27 in the bottom part of the glazing opening receiving the new glass pane 10. The operator then inserts the lateral edge of the glass pane 10 into the receiving groove 23 by a translational movement, for example by tapping the section of the opposite lateral edge of the glass pane 10 with the hand or using a "wooden hand" by levering. Once the lateral edge is inserted into the receiving groove 23, a tilting movement makes it possible to fully insert the glass pane 10 into the glazing opening of the casement according to the invention, by causing the opposite lateral edge to bear against the seal 9 fixed in the part of the receiving groove 24 of one 26 of the first 22 and second 26 lateral uprights. This tilting is done about the axis parallel to the longitudinal axis of the other 22 of the first 22 and second 26 lateral uprights. The glass pane 10 is then held in place by the receiving groove 23.

Next, subsequently, the operator fits the cross member covers 30 by inserting the lateral end 32 of each cross member cover 30 into the receiving groove 23, then by clipping the cross member covers 30 onto the cross members delimiting the glazing opening receiving the glass pane 10.

Next, the operator fits the glazing bead 50 back in place. This finalizes the receiving groove 24 making it possible to retain in place the lateral edge of the glass pane 10 received in the receiving groove 24 and the lateral end 31 of the cross member covers 30 previously put back in place. The reversible fixing means 6 are put back in place to grip the glazing bead onto one 26 of the first 22 and second 26 lateral uprights.

Next, the operator fits the glazing bead cover 40 onto the glazing bead 50, by clipping by making the hooks of the branches 41 of the glazing bead cover 40 cooperate with the protuberances of the lateral walls 54 of the glazing bead 50. That conceals the reversible fixing means 6 and makes them inaccessible from outside.

Finally, the operator fits the locking and securing protective trim using the specific tools.

All the maintenance operations just described in relation to methods for removing and fitting a glass pane according to the invention are performed only on the platform side because all the removable elements (protective trim, covers, glazing bead, glass pane) are accessible from the platform face of the casement according to the invention. That makes it possible to conserve the casement according to the invention which undergoes maintenance while closed without neutralizing the traffic lane. That makes it possible to perform the maintenance at any time without interrupting service. The fitting and removal methods according to the invention are rapid, which makes it possible to replace a glass pane in approximately 15 minutes. The particular arrangement of the casement according to the invention makes fixing the glazing beads 50 inviolable.

Obviously, the invention can have numerous modifications made to it without departing from the scope of the invention.

The invention claimed is:

1. A platform landing door casement comprising:

a platform face;

a casement frame comprising first and second lateral uprights separated from one another by first and second cross members, the first and second lateral uprights and the first and second cross members delimiting a glazing opening;

a glass pane mounted in the glazing opening by being received in the first and second lateral uprights and the first and second cross members;

a glazing bead mounted removably on one of the first and second lateral uprights by reversible fixing means, for retaining the glass pane in the glazing opening; and, a glazing bead cover mounted removably on the glazing bead to conceal the reversible fixing means;

wherein the glass pane, the glazing bead, and the glazing bead cover are mounted on the platform face side and the casement further comprises, on the platform face side, a protective trim for locking and securing the glazing bead cover on the glazing bead.

2. The casement according to claim 1, wherein the other of the first and second lateral uprights comprises a profile member comprising a groove for receiving and holding a lateral edge of the glass pane.

3. The casement according to claim 2, wherein the profile member is a single piece.

4. The casement according to claim 1, further comprising first and second cross member covers mounted, on the platform face side, removably on the first and second cross members respectively, the first and second cross member covers comprising a first lateral end received in the other of the first and second lateral uprights and a second lateral end, opposite the first lateral end, retained by the glazing bead.

5. The casement according to claim 4, wherein the first and second cross member covers are clipped onto the first and second cross members respectively.

6. The casement according to claim 1, wherein the glazing bead cover is clipped onto the glazing bead.

7. The casement according to claim 1, wherein the reversible fixing means comprise fixing screws.

8. The casement according to claim 1, wherein the glass pane comprises an anti-graffiti film.

9. A method for removing a glass pane from a casement according to claim 1 comprising, from the platform face, sequential steps of:

unlocking and removing the protective trim;

removing the glazing bead cover;

removing the reversible fixing means and removing the glazing bead; and, removing the glass pane from the glazing opening.

10. The method according to claim 9, wherein, prior to the removal of the glass pane and following the removal of the glazing bead, the method comprises a step of removing the first and second cross member covers.

11. The method according to claim 9, wherein the removal of the glass pane is performed by tilting the glass pane on an axis parallel to a longitudinal axis of the other of the first and second lateral uprights.

12. A method for fitting a glass pane of a casement according to claim 8 comprising, from the platform face, sequential steps of:

placing the glass pane in the glazing opening;

placing the glazing bead;

placing reversible fixing means in one of the first and second lateral uprights;

placing the glazing bead cover on the glazing bead; and, placing and locking of the protective trim.

13. The method according to claim 12, wherein, following the placing of the glass pane and prior to the placing of the glazing bead, the method comprises a step of placing first and second cross member covers on the first and second cross members respectively.

14. The method according to claim 12, wherein the step of placing the glass pane comprises sequential sub steps of:

pressing a bottom edge of the glass pane onto a bottom cross member out of the first and second cross members;

insertion of a lateral edge of the glass pane into the other of the first and second lateral uprights; and, tilting of the glass pane in the opening on an axis parallel to a longitudinal axis of the other of the first and second lateral uprights.

15. The method according to claim 12, further comprising a preliminary step of cleaning and/or replacing seals of the glazing opening.

* * * * *